United States Patent [19]

Amos et al.

[11] Patent Number: 4,511,148

[45] **Date of Patent: * Apr. 16, 1985**

[54] SCOOP AND CUP DEVICE FOR PLAYING A GAME

[75] Inventors: Homer C. Amos, Palm Springs, Calif.; Joseph C. Benedyk, Highland Park; Carl E. Scheie, Libertyville, both of Ill.; William R. McGlove, Albuquerque, N. Mex.

[73] Assignee: Brunswick Corporation, Skokie, Ill.

[ * ] Notice: The portion of the term of this patent subsequent to May 22, 2001 has been disclaimed.

[21] Appl. No.: 363,964

[22] Filed: Mar. 31, 1982

Related U.S. Application Data

[63] Continuation of Ser. No. 158,128, Jun. 10, 1980, abandoned.

[51] Int. Cl.[3] ..... A63B 59/00; A63B 71/02

[52] U.S. Cl. ..... 273/326; 273/411

[58] Field of Search ..... 273/318, 322, 323, 326, 273/327, 411, DIG. 8, 73 F; 272/3

[56] References Cited

U.S. PATENT DOCUMENTS

| | | | |
|---|---|---|---|
| 642,638 | 2/1900 | Smith | 273/326 |
| 1,022,186 | 4/1912 | Engler | 273/322 |
| 2,029,790 | 2/1936 | Philipp | 273/326 |
| 2,930,618 | 3/1960 | Glintz | 273/323 |
| 3,635,482 | 1/1972 | Holman | 273/DIG. 8 X |
| 3,644,168 | 2/1972 | Bonk et al. | 273/DIG. 8 X |
| 3,671,040 | 6/1972 | Meyer et al. | 273/326 |
| 3,690,658 | 9/1972 | Howe | 273/73 F X |
| 3,697,074 | 10/1972 | Duncan | 273/326 |
| 4,068,840 | 1/1978 | Spaulding, Jr. | 273/411 X |
| 4,098,508 | 7/1978 | Gandy | 273/326 |

FOREIGN PATENT DOCUMENTS

| | | | |
|---|---|---|---|
| 110771 | 2/1935 | Austria | 273/322 |
| 64794 | 6/1955 | France | 273/323 |

OTHER PUBLICATIONS

*Sports Illustrated,* vol. 18, #1, p. 41, Jan. 1, 1963.
*Sporting Goods Dealer,* Jun. 1971, p. 140.

*Primary Examiner*—William H. Grieb
*Attorney, Agent, or Firm*—John G. Heimovics

[57] ABSTRACT

A ball catching and throwing device that comprises a scoop means at one end and a cup means at the other end. The scoop means is adapted to catch a ball and the cup means is adapted to receive the ball after the catching operation is performed. A ball has been tuned or impedance matched to the scoop-cup means so that the ball will not rebound out of the scoop means during the catching operation. The ball and scoop means have also been tuned and adapted to create a pleasurable, playable ball game in a walled court.

87 Claims, 19 Drawing Figures

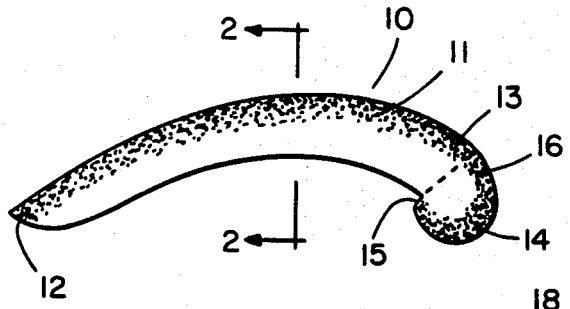
FIG. 1
FIG. 19
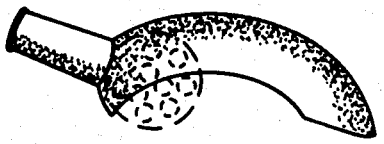
PRIOR ART
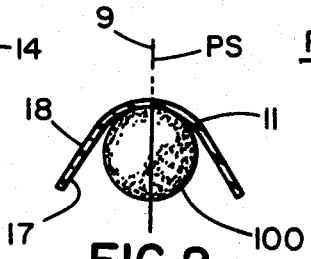
FIG. 2
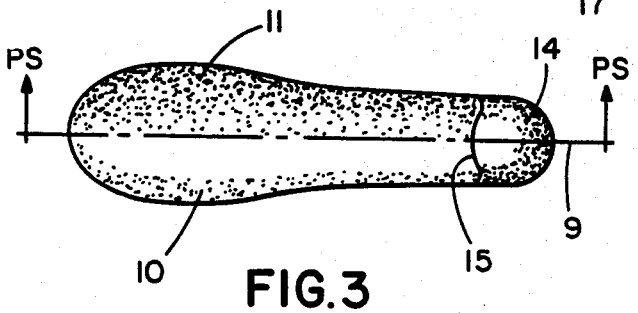
FIG. 3
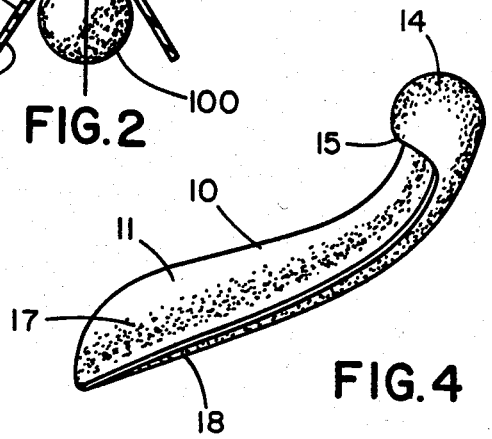
FIG. 4
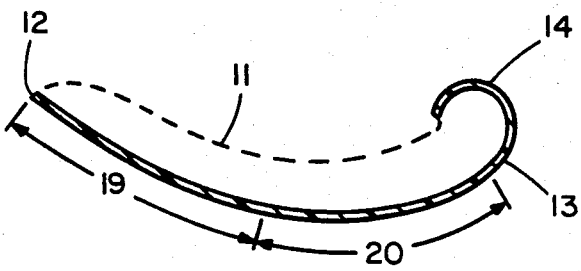
FIG. 5
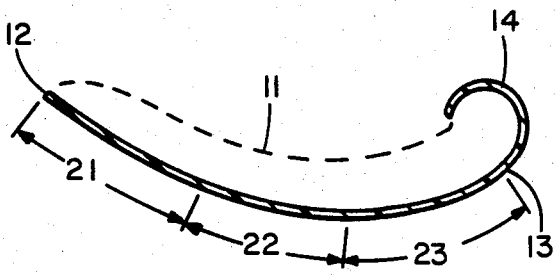
FIG. 6
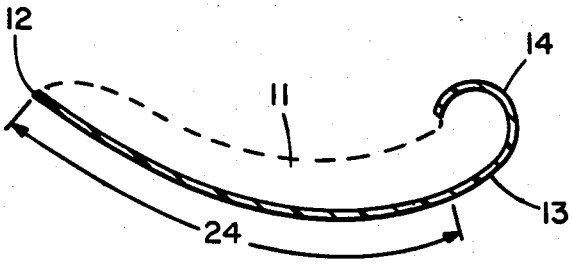
FIG. 7
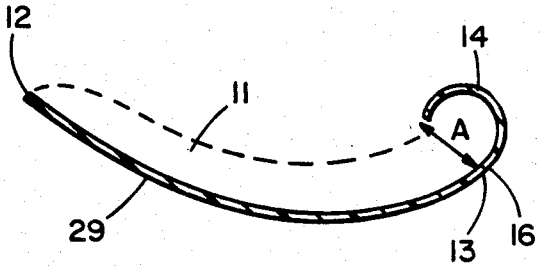
FIG. 8

SCOOP AND CUP DEVICE FOR PLAYING A GAME

This is a continuation of application Ser. No. 158,128, filed June 10, 1980, now abandoned.

BACKGROUND OF THE INVENTION

1. Field of the Invention

This invention is in the field of games, and more particularly, in the field of games of the type that uses a unitary ball catching and throwing device.

2. Description of the Prior Art

Pelota is the generic name for a group of ball games originally developed by the Basques. Some of these games exploit the mechanical advantage gained by throwing a ball from a basket. The game in which this mechanical advantage has been carried to an extreme is known, in this country, as "jai alai". The jai alai game is played by using a "chistera". This chistera is a heavy elongated wicker basket with a curved drooping belly. The basket is usually strapped to the hand and wrist of a player. The jai alai court is normally 90 yards long having a front wall, back wall and one side wall. A small, hard and rather heavy ball is used. The drooping belly portion of the basket is used to catch a ball rebounding from either the front wall or side wall. Once the ball is caught in the drooping belly and positioned, the basket is used to hurl the ball from that position toward the front wall. It requires years of training to develop the skill necessary to play jai alai because it is extremely difficult to catch a ball in the belly of a basket. It is reported that the ball achieves speeds of approximately 140 miles per hour during play of the game. It is equally difficult to learn how to hurl the ball from the basket and especially to hurl the ball where it can achieve speeds of about 140 miles an hour.

Because the game of jai alai is played in only about four states in the United States, because the game is so difficult to learn to play, and because the courts are so large and expensive to build, jai alai has not become a major or, as a matter of fact, a minor participant sport in the United States. However, there have been attempts to replicate or simulate some of the aspects of a modified jai alai game for the general public. One of these attempts was to make a smaller size and lighter weight chistera from plastic. The belley portion was provided with a resilient layer of padding to assist in catching the ball. This device is the subject of U.S. Pat. No. 4,098,508 and suggests that it is to be used to play "jai alai" on a conventional handball or racquetball court. However, the patent appears to be silient as to the type of ball to be used. Therefore, the device obviously was not tuned to a player, a court or a ball. This prior art also obviously does not teach a game.

In an old U.S. Pat. No. 1,022,186 a plurality of throwing devices are shown that are adapted to throw balls such as baseballs, tennis balls, badminton balls or birdies (maybe badminton was played with a ball in 1912) cricket balls and the like. In this device a pair of curved edges are provided to throw the projectiles mentioned. We have not been able to find either of these devices in the marketplace or in old catalogs and, therefore, must assume that they did not enjoy any commercial success.

In our search for prior art devices, we did find one toy, that was supposed to catch balls, manufactured by Cosom Division of Schaper Manufacturing Company and was possibly sold under the trademark name of Safe-T-Play. This device comprised a circular shape with a hollow handle made from a soft resilient plastic material. A side elevation view of this device with the ball shown in phantom is depicted in the drawings and labeled as "PRIOR ART". This device was found very awkward and clumsy to use and did not catch balls well. It also did not throw the balls well because its curvature was almost that of a circle.

Several years ago, a child's toy called "Trac Ball" was introduced into the marketplace. This Trac Ball toy seems to be similar to a toy described in U.S. Pat. No. 4,045,026. The toy utilizes a plastic basket with a handle for throwing and catching a light weight blow molded hollow sphere having a plurality of external ridges. The sphere or ball being made from such light weight material as expanded polystyrene. This patent teaches that serrated tracks in the basket impart spin to the ridged ball but if a smooth ball is used no spin can be imparted by the serrated tracks when the ball is thrown. From the commercially available toy described by this United States Patent, it was determined that a pleasurable or challenging court-type ball game could not be played. In fact with the toy basket and ball provided, no court game could be played. Further, the patent covering this toy does not suggest that a court game could be played.

As any good golfer knows, as any good tennis player knows, as any good baseball player knows, there must be a good impedance match (as will be explained more fully hereinafter) between a golf club and a golf ball, a tennis racquet and a tennis ball, or a baseball and a baseball bat so that when hitting the ball properly a feeling of pleasure exists. In fact, this feeling is best described as kinesthetic pleasure. Concomitantly, it is a thrilling sensation to hit a ball in the "sweet spot" with a golf club, tennis racquet, baseball bat and the like; somehow this makes humans happy. Conversely, when trying to hit a baseball with a tennis racquet or a tennis ball with a badminton racquet there is no pleasure imparted to the player since the feeling is all wrong. Certainly, there is no kinesthetic pleasure experienced by the player.

It has been ascertained that in this vast area of prior art games, and in particular court-type games, i.e., tennis, racquetball, squash and the like that the racquet, the ball and the court are all tuned or impedance matched to the player so that a pleasurable game is experienced. These games were not scientifically designed but evolved over many, many years. In fact, there is a large body of prior art in the U.S. Patent Office regarding just the evolutionary development of tennis racquets and tennis balls.

We modified several "Trac Ball" baskets to make them stronger and tried using them with a tennis ball to play a game in a racquetball court. Almost no pleasure was derived from this attempted game because the player, the basket, the ball and the court were not tuned; there were simply impedance mismatches. Up until now, none of the attempts to simulate, duplicate, replicate or approximate a court style jai alai game have been well thought out wherein the relationship between the ball catching and throwing device and the ball were scientifically designed. In fact, the basket whose shape and function are so critical, has apparently received little or no attention.

Based upon our attempt to use the "Trac Ball" baskets in a racquetball court, it was recognized that to provide a playable game it would be necessary to tune or impedance match the various components of the game.

SUMMARY OF THE INVENTION

In order to overcome the disadvantages and problems of the prior art devices, we have invented a new and unique device for throwing and catching balls. This device comprehends a scoop and cup means that has been tuned or impedance matched to the ball. The ball and the device have further been impedance matched to a player for use in several basic types of courts.

A player using the device with a properly matched ball experiences kinesthetic pleasure when throwing and catching the ball against a wall of a court. Since no other device like our device exists, we have named our device a cesta. We have specific configurations of our cesta with very special types of balls having critical weight, size and bounce limitations.

It is therefore an object of this invention to provide a new and unique ball throwing and catching device comprising a scoop portion and a cup portion.

Another object of the invention is the provision for a scoop-cup device whereby a ball can be thrown with different spin as desired.

Yet another object of this invention is the provision for a part of the curve of the scoop portion of the cesta to be a hyperbolic spiral.

Still another object of this invention is the provision for a plane of symmetry that divides the cesta into a right-hand portion and a left-hand portion.

Still yet another object of this invention is the provision for the total curve of the scoop means to be a hyperbolic spiral.

Yet still another object of this invention is the provision for the total curve of the scoop means and the cup means to comprise a hyperbolic spiral.

And yet another object of this invention is the provision for the cesta to have a moment of inertia ranging from $6\times4$ to $12\times10^4$ gram-centimeters$^2$.

Still another object of the invention is the provision for the cesta to have a weight ranging from 130 grams to 300 grams.

And yet another object of the invention is the provision for a ball tuned or impedance matched to the cesta that has a weight ranging from 70 grams to 90 grams.

Yet another object of the invention is the provision for such a ball having a coefficient of restitution (a measurement related to bounce) ranging from 0.60 to about 0.75.

Another object of the invention is the provision where such a ball has a diameter ranging from 5.5 centimeters to 7 centimeters.

Yet another object of the invention is the provision for the cesta to have a length ranging from 30 centimeters to 60 centimeters.

And still another object of the invention is the provision where the cesta is made substantially rigid and wherein the scoop means is without any padding to catch the ball.

And yet another object of the invention is the provision for the scoop means to be fasioned so that a ball striking the scoop means will roll into the cup means and not rebound from the scoop means.

Another object of the invention is the provision for a player to experience kinesthetic pleasure when using the cesta and ball in a court.

Still another object of the invention is the provision for holding means to permit a person to comfortably hold the cesta.

Still another object of the invention is the provision to attach a person's hand to cesta to permit the person to execute the catching and throwing manner without fatiguing the hand.

In addition to all the objects listed above, our invention also comprehends a game that comprises a court with four walls, a ball and a ball catching and throwing element. The ball and the element are tuned or impedance matched such that a person playing a game in a court finds it pleasurable. In order to provide such an inventive game, the ball, the cesta and the game have been designed and tuned to fit an easily available court, i.e., a racquetball court.

Therefore, it is an object of our invention for an element that has a scoop means for catching and throwing a ball and a cup means for holding the ball once caught.

Another object of the invention is the provision for a scoop means that has a modified V-shape or modified U-shape cross-sectional configuration.

Yet another object of the invention is the provision for a scoop-cup means to be made from a plastic.

Still another object of the invention is the provision for the scoop means when held by an individual approximately parallel to the floor of a court and when a ball is rebounding from a wall and strikes the scoop means near the distal end, the ball will roll up into the cup means.

The above and other and further objects, features and advantages will be more readily understood by reference to the following detailed description, the accompanying drawings and the appended claims.

DESCRIPTION OF THE DRAWINGS

FIG. 1 is a side elevation view of one embodiment of the invention;

FIG. 2 is a cross-sectional view of the scoop means portion of the invention taken along a line 2—2 of FIG. 1 and also depicting a ball in the scoop means;

FIG. 3 is a top plan view of the embodiment of the invention shown in FIG. 1;

FIG. 4 is a perspective view of one embodiment of the invention;

FIG. 5 is a cross-sectional side view of one embodiment of the invention taken along the plane of symmetry PS—PS of FIG. 3;

FIG. 6 is a cross-sectional side view of another embodiment of the invention taken along the plane of symmetry PS—PS of FIG. 3;

FIG. 7 is a cross-sectional side view of another embodiment of the invention taken along the plane of symmetry PS—PS of FIG. 3;

FIG. 8 is a cross-sectional side view of another embodiment of the invention taken along the plane of symmetry PS—PS of FIG. 3;

FIG. 19 is a side elevation view of one item of prior art.

DESCRIPTION OF THE PREFERRED EMBODIMENTS

Figure 9:
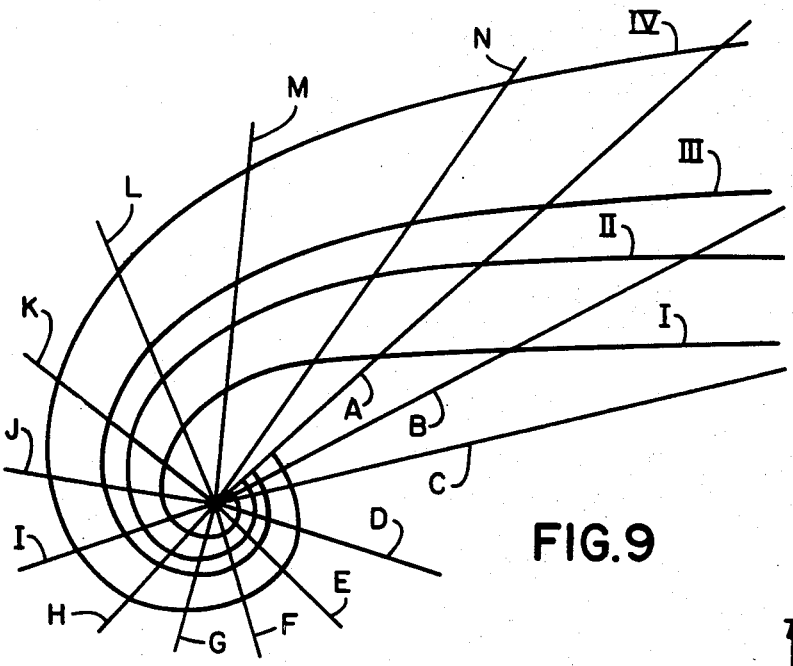
FIG. 9 is a schematic view of a series of hyperbolic spiral curves I, II, III and IV formed about a center axis along radial lines A–N and where a segment is that portion of a curve located between two adjacent radial lines, i.e., L to M on curve IV defines a segment.

This invention comprehends a ball catching and throwing device (hereinafter referred to as a cesta) that has been tuned, or more precisely, impedance matched to a series of balls for preferred play in a court. The invention comprehends the use of a court having one or more relatively smooth walls. The invention also comprehends a series of balls tuned to the cesta such that when a player, using the cesta, throws a ball or catches a ball rebounding from a wall a pleasure feeling is experienced. In a preferred embodiment of the invention as depicted in FIG. 1, the cesta 10 comprises a scoop portion 11 having a distal end 12 and a proximal end 13 and a cup portion 14 having an open edge 15 and a closed edge 16. The cesta 10 can be made in two parts such that the proximal end 13 of the scoop means 11 is secured to the closed edge 16 of the cup means 14. Alternatively, the cesta 10 can be made such that scoop means 11 and the cup means 14 are integral. The scoop means 11 has an inner surface 17 and an outer surface 18 as shown in FIGS. 2 and 4. The cesta 10 (scoop-cup means) depicted in FIG. 3 has a plane of symmetry dividing the cesta into right hand and left hand sections which are equal but opposite with axis 9 representing the plane. The cesta can be made on a mold with one right-hand section and one left-hand section and then joined at the plane of symmetry to make a completed cesta.

It has been found that at least a portion of the scoop means 11 at the axis and plane 9 has the configuration of a hyperbolic spiral thereby permitting a player using the cesta to catch a ball in a comfortable manner. In certain types of catches, the hyperbolic spiral permits a ball striking the cesta to roll up into the cup means 14. Conversely, when throwing the ball from the cup means 14 the ball rolls out along the scoop means 11.

In the embodiment of the cesta shown in cross-sectional view in FIG. 5, either portion 19 or portion 20 of the curve can have the shape of a hyperbolic spiral. In an alternative embodiment of the invention shown in FIG. 6 at least one of the portions 21, 22, or 23 along the curve of the scoop means 11 has the configuration of a hyperbolic spiral. Several of the alternative embodiments included within the scope of the invention and depicted in FIG. 6 provide that two of the three portions of the curve have the shape of a hyperbolic spiral.

In one preferred embodiment of the invention, a majority of the scoop means 11 has a hyperbolic spiral curve configuration portion 24 as shown in FIG. 7. And, preferably, the total cesta has a curve that is substantially totally a hyperbolic spiral curve similar to that depicted in FIG. 8. In all the embodiments of the invention discussed hereinabove, the distance between the open edge 15 and the closed edge 16, represented by the dimension "A", is at least 5 percent greater than the diameter of the ball in order for the ball to be able to roll into or be caught by the cup means 15. Preferrably, the dimension "A" ranges from 5 to 80 percent greater than the diameter of the ball; but, a larger dimension than 80 percent is fully contemplated.

In the preferred embodiment of the invention as shown in FIG. 8, the hyperbolic spiral curve has a formula in polar coordinates of $$R\theta = C$$

where:

R is the radius measured in centimeters;

$\theta$ is the angle measured in radians; and

C is a constant measured in centimeter-radians. In constructing the hyperbolic spiral curve that is represented by the numeral 29 of the embodiment shown in FIG. 8, the values of R range from 1.5 to 60 centimeters; the values of C range from 10 to 30 centimeter-radians and $\theta$ for hyperbolic curve should comprise at least 2 radians. FIG. 9 is a schematic representation of the minimum and maximum hyperbolic spiral curves contemplated therein with several intermediate curves shown therewith. In FIG. 9 the C values of the four curves are as follows:

| Curve | C |
|---|---|
| I | 10. |
| II | 16 |
| III | 20 |
| IV | 30 |

As used hereinafter, the term "hyperbolic segment" or "segment" refers to a portion of a radian spacing along one of the curves. In the preferred embodiments of the invention, all of the curves shown in FIGS. 1 and 3–7 of the scoop means 11 comprise at least two of the segments as part of the scoop curve. The segments will be similar to those depicted between the lines C to B to A to N and to M or C to B to A (at the larger diameter). The segments need not be immediately adjacent to each other on the scoop-means curve but can be separated by a partial or full radian span that has another configuration such as a straight portion or a different type of curve such as a portion of a circle. These different types of curves comprise at least a portion of the hyperbolic spiral curve of the cesta and are fully contemplated to be within the scope of this invention. In fact, the segments need not be immediately adjacent but can be spaced apart by a partial radian span, a whole radian span, or even as much as a two radian span that are not the hyperbolic curve as long as adjacent and/or intermediate portions are of the hyperbolic spiral curve configuration. A straight or curved portion can be inserted between the segments of the hyperbolic spiral curve and yet provide a cesta having an adequate curve to catch and throw the ball.

It is contemplated by the invention that embodiments of the hyperbolic spiral curves shown in FIG. 9 have the values of R in centimeters in the following Table 1:

TABLE 1

| | Values of R | | | |
|---|---|---|---|---|
| θ | C = 10.0 | C = 16.0 | C = 20.00 | C = 30.0 |
| .25 | 40.0 | 64.0 | 80.0 | 120.0 |
| .50 | 20.0 | 32.0 | 40.0 | 60.0 |
| .75 | 13.3 | 21.3 | 26.7 | 40.0 |
| 1.00 | 10.0 | 16.0 | 20.0 | 30.0 |
| 1.50 | 6.7 | 10.6 | 13.3 | 20.0 |
| 2.00 | 5.0 | 8.0 | 10.0 | 15.0 |
| 2.50 | 4.0 | 6.4 | 8.0 | 12.0 |
| 3.00 | 3.3 | 5.3 | 6.7 | 10.0 |
| 3.50 | 2.9 | 4.6 | 5.7 | 8.6 |
| 4.00 | 2.5 | 4.0 | 5.0 | 7.5 |
| 4.50 | 2.2 | 3.6 | 4.4 | 6.7 |
| 5.00 | 2.0 | 3.2 | 4.0 | 6.0 |
| 5.50 | 1.8 | 2.9 | 3.6 | 5.5 |
| 6.00 | 1.7 | 2.7 | 3.3 | 5.0 |
| 6.50 | 1.5 | 2.5 | 3.1 | 4.6 |
| 7.00 | 1.4 | 2.3 | 2.9 | 4.3 |

Figure 10:
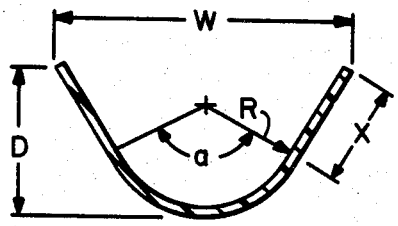
FIG. 10 is a modified V-shape cross-sectional view of the invention such as taken along line 2—2 of FIG. 1 depicting the dimensional aspects of the cross-sectional configuration.

In a preferred embodiment of the invention, a major part of the scoop portion curve of the cesta is the hyperbolic spiral such as that portion from the radial line K and including segments through radial line A and even as far as radial line B for curve I. It has been found that the overall length of the chelesta should be between 30 centimeters and 60 centimeters and more preferably the length of the cesta ranges from 35 to 50 centimeters. It has been found that the cross-sectional shape of the scoop means, greatly contributes to the cesta ball catching and throwing ability. The cesta can have a U-shaped or V-shaped cross-sectional configuration and preferably has a modified U-shape of V-shape or a combination of a U-shape and a V-shape configurations that are blended together. Additionally, it is fully contemplated that the cross-sectional shapes can vary along the length of the scoop. FIG. 10 depicts the general V-shaped configuration with:

a being the included angle of the curve;
R being the radius;
D being the depth of the scoop means;
X being the length of the straight side of the modified V-shape; and
W being the width of the top portion of the cross-sectional configuration of the scoop means.

Figure 11:
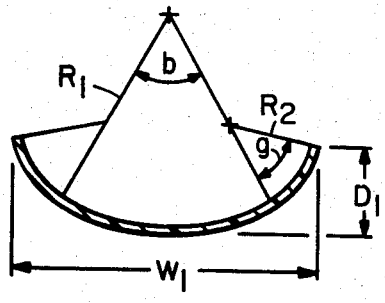
FIG. 11 is a modified U-shape cross-sectional view of another embodiment of the invention which could have been taken along line 2—2 of FIG. 1 depicting the dimensional aspects with a cross-sectional configuration.

The cross-sectional shapes vary from the distal end 12 to the proximal end 13. In fact, it has been found desirable to flare the distal end in some instances. The radius R ranges from 3 centimeters to 5 centimeters; the angle a ranges from 80 degrees to 180 degrees; the depth D ranges from 2 centimeters to 6½ centimeters; the straight length of the side X varies from slightly more than zero to 6 centimeters and the width W ranges from 4 centimeters to 13 centimeters. Preferably, these dimensions have the following ranges:

R=3 to 4.5 centimeters;
a=90 degrees to 180 degrees;
D=2.8 to 5.5 centimeters;
X=3 to 5.5 centimeters;
W=6.5 to 12 centimeters;

In the embodiment of the invention when the cross-sectional configuration of the cesta is a modified U-shape, as shown in FIG. 11 wherein:

$W_1$ is the overall width;
$D_1$ is the depth;
$R_1$ is the primary radius;
$R_2$ is the secondary radius;
b is the included angle for the curved portion at radius $R_1$; and
g is the included angle for the secondary radius $R_2$.

Figure 12:
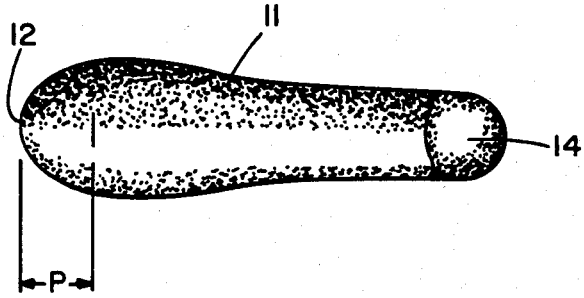
FIG. 12 is a top plan view of an embodiment of the invention wherein the dimension P represents a distance from the distal end of the scoop means.

Again, the cross-sectional shape varies from the distal end to the proximal with the width $W_1$ ranging from 6 to 11.5 centimeters; the depth $D_1$ ranging from 2.5 to 4.5 centimeters; the primary radius $R_1$ ranging from 3.5 to 11 centimeters; the secondary radius $R_2$ ranging from 2.7 to 4.3 centimeters; the included angle b ranging from 30 degrees to 180 degrees; and the included angle g ranging from 45 degrees to 75 degrees. Preferably these dimensions are:

$W_1$ ranges from 8 to 10.5 centimeters;
$D_1$ ranges from 2.7 to 3.8 centimeters;
$R_1$ ranges from 4 to 10 centimeters;
$R_2$ ranges from 3 to 4 centimeters;
Angle b ranges from 34 to 170 degrees;
Angle g ranges from 50 to 66 degrees;

A schematic front view of the cesta is depicted in FIG. 12 wherein the dimension P is measured in centimeters from the distal end 12 toward the cup 14. The following represent Examples of the cesta that were made with different cross-sectional configurations and different dimensions:

EXAMPLE A

The cross-sectional configuration of this cesta was made in accordance with the V-shape of FIG. 10. The different cross-sectional sections having the following dimensions.

| P | R | a | X | W | D |
|---|---|---|---|---|---|
| 5–10 | 3.65 | 90 | 4.0 | 10.8 | 3.5 |
| 10–15 | 3.65 | 100 | 4.0 | 10.6 4.0 | |
| 15–20 | 3.65 | 110 | 3.3 | 9.6 | 4.0 |
| 20–25 | 3.65 | 120 | 2.0 | 8.2 | 3.60 |
| 25–30 | 3.65 | 175 | 0.0 | 7.2 | 3.50 |
| 30–35 | 3.45 | 175 | 0.0 | 6.8 | 3.40 |
| 35–40 | 3.45 | 180 | 0.0 | 6.8 | 3.45 |
| 40–45 | 3.45 | 180 | 0.5 | 6.8 | 3.60 |

EXAMPLE B

The cross-sectional configuration of this cesta was made in accordance with the V-shape of FIG. 10. The different cross-sectional sections having the following dimensions:

| P | R | a | X | W | D |
|---|---|---|---|---|---|
| 5–10 | 3.65 | 90 | 4.0 | 10.8 | 3.5 |
| 10–15 | 3.65 | 100 | 4.0 | 10.6 | 4.0 |
| 15–20 | 3.65 | 110 | 3.3 | 9.6 | 4.0 |
| 20–25 | 3.65 | 120 | 2.0 | 8.2 | 3.60 |
| 25–30 | 3.65 | 180 | 0.0 | 7.2 | 3.65 |
| 30–35 | 3.45 | 180 | 0.5 | 6.8 | 3.70 |

EXAMPLE C

The cross-sectional configuration of this cesta was made in accordance with the V-shape of FIG. 10. The different cross-sectional sections having the following dimensions:

| P | R | a | X | W | D |
|---|---|---|---|---|---|
| 5–10 | 3.5 | 90 | 5.0 | 11.6 | 4.6 |
| 10–15 | 3.5 | 90 | 4.0 | 11.5 | 5.0 |
| 15–20 | 4.0 | 105 | 3.0 | 10.1 | 4.6 |
| 20–25 | 4.2 | 180 | 0.0 | 8.9 | 4.2 |
| 25–30 | 3.9 | 180 | 0.8 | 7.9 | 4.7 |
| 30–35 | 3.6 | 180 | 1.2 | 7.4 | 4.8 |

EXAMPLE D

The cross-sectional configuration of this cesta was made in accordance with the V-shape of FIG. 10. The different cross-sectional sections having the following dimensions:

| P | R | a | X | W | D |
|---|---|---|---|---|---|
| 5–10 | 3.4 | 90 | 5.0 | 12.0 | 4.5 |
| 10–15 | 3.2 | 95 | 5.0 | 11.3 | 4.8 |
| 15–20 | 3.2 | 98 | 4.6 | 10.2 | 4.8 |
| 20–25 | 3.2 | 103 | 4.0 | 9.3 | 4.8 |
| 25–30 | 3.4 | 130 | 3.2 | 8.2 | 4.9 |
| 30–35 | 3.3 | 140 | 3.2 | 7.9 | 5.4 |

EXAMPLE E

The cross-sectional configuration of this cesta was made in accordance with the U-shape of FIG. 11. The different cross-sectional sections having the following dimensions:

| P | $R_1$ | b | $R_2$ | g | $W_1$ | $D_1$ |
|---|---|---|---|---|---|---|
| 5–10 | 10.0 | 34 | 4.0 | 50 | 10.5 | 2.7 |
| 10–15 | 9.0 | 38 | 3.5 | 55 | 10.0 | 2.8 |
| 15–20 | 8.0 | 40 | 3.5 | 60 | 9.2 | 2.9 |
| 20–25 | 7.0 | 42 | 3.0 | 66 | 8.6 | 3.0 |
| 25–30 | 5.0 | 74 | 3.0 | 52 | 8.2 | 3.4 |
| 30–35 | 4.3 | 170 | — | — | 8.2 | 3.8 |

EXAMPLE F

The cross-sectional configuration of this cesta was made in accordance with the U-shape of FIG. 11. The different cross-sectional sections having the following dimensions:

| P | $R_1$ | b | $R_2$ | g | $W_1$ | $D_1$ |
|---|---|---|---|---|---|---|
| 5–10 | 9.0 | 38 | 3.5 | 55 | 10.0 | 2.8 |
| 10–15 | 8.0 | 40 | 3.5 | 60 | 9.2 | 2.9 |
| 15–20 | 7.0 | 42 | 3.0 | 66 | 8.6 | 3.0 |
| 20–25 | 5.0 | 74 | 3.0 | 62 | 8.2 | 3.4 |
| 25–30 | 4.3 | 170 | — | — | 8.2 | 3.8 |

In the making of the scoop means 11, the following Table 2 defines the preferred ranges of width of the scoop means relative to the distance from the distal end.

TABLE 2

| Distance from Distal End in Centimeters | Width in Centimeters |
|---|---|
| 5–10 | 9–13 |
| 10–15 | 8.5–12 |
| 15–20 | 8–11.5 |
| 20–25 | 7.5–10.5 |
| 25–30 | 6.5–9.0 |
| 30–35 | 6–9 |

It has been found that in the embodiments of our invention that the combination of the hyperbolic spiral portion of the inner surface 17 combines in a synergistic and unexpected manner with the modified U-shape or V-shape cross-sectional configuration of the scoop means 11 to impart spin to the ball when it is thrown from the cup means 14. This is made possible since the ball can be made to initially roll out along the central axis 9 or plane of symmetry PS and then roll off the side portion along the flat or curved portion of the cross-sectional configuration. An example of the off center roll of the ball 100 is shown in FIG. 2. In a preferred embodiment of the invention, the ball should have a radius smaller than the radius of the cross-sectional configuration of the scoop means when the scoop means is a modified V-shape as shown in FIG. 10.

It is fully contemplated that the hyperbolic spiral can be deviated from such that the scoop means can have a curved configuration of a circular arc (such as can be observed in FIG. 14) provided that the scoop-cup combination has a length ranging from 30 centimeters to 60 centimeters, a weight of approximately 150 grams to 300 grams, a polar moment of inertia (as hereinafter explained) ranging from $6\times10^4$ to $12\times10^4$ grams-centimeters$^2$, a depth of the scoop means ranging from about 2 centimeters to 6 centimeters and has a value for $mL^2/I$ greater than 0.85. Obviously, the circular arc can also be deviated from and still bring the scoop configuration within the scope of our invention.

It is contemplated that the cesta can be made from a fabric made from fibrous materials such as nylon, polyester, fiber glass, acrylic, wool, kevlar, mineral wool, cotton, rayon, silk, jute, and polypropylene impregnated with a plastic material such as ABS, epoxy, polypropylene, polyethylene, polycarbonate, polyester, polyimide, polyamide and phenolic to name only a few. One or more impregnated layers can be layed up on a mandrel having the desired cesta configuration. If desired, layers of plastic material can be placed in between the impregnated layers of fabric. These laminates can be cured, if desired.

Figure 13:
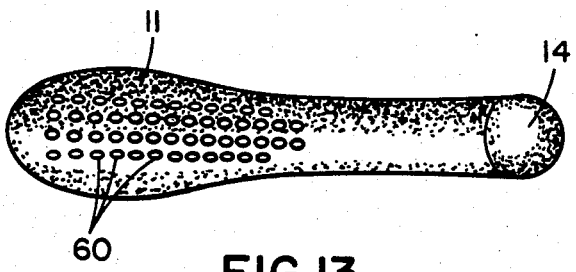
FIG. 13 is a top plan view of an elevation of the invention where holes are depicted in the scoop means.

Alternatively, in another embodiment the cesta can be made from a textile fabric impregnated by a foamed plastic material. In an alternate embodiment, the textile fabric, either plain or impregnated with a plastic material, can have a plastic foam sandwiched therebetween two fabric layers. In both types of embodiments, the plastic foam can be made from polyurethane, polyester, polyamide, blown cellular foam, such as styrofoam, and a plurality of syntatic foams, just to name a few. In another alternate embodiment, plastic material with or without filler and/or reinforcing materials such as textile-type fibers (made from the type of fibrous materials as listed hereinabove for fabric layers) can be injected into a mold to make the scoop means 11, the cup means 14 or both the scoop and cup means together in one integral piece. If a chillable injection mold is used, some foam plastic materials can be injected therein wherein hard outer skins are formed with a less dense core. It has been found necessary that the cesta be sufficiently rigid to be useable as a ball catching and throwing device. Obviously when thin material is used, the cesta structure can be reinforced on the outer surface 18 with ridges or longitudinal supports. Depending upon the method of manufacture and the weight of the material utilized, the cesta should have a thickness ranging from about 0.125 centimeters to 1 centimeter. In order for an individual to play with the cesta for any period of time, it has been found necessary that the cesta (without considering the hand attaching means such as a glove) should have a weight from about 130 grams to about 300 grams. In order to lighten the weight of the cesta when made from denser materials, holes 60 can be placed in the scoop means 11, as shown in FIG. 13, without affecting the rigidity or playability of the cesta.

Figure 14:
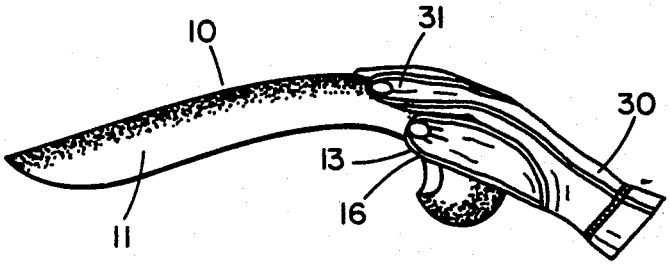
FIG. 14 is a side elevation view of an embodiment of the invention.
Figure 15:
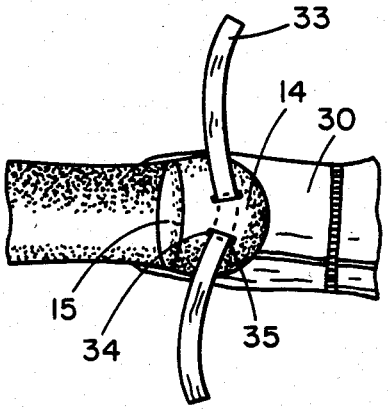
FIG. 15 is a partial top elevation view of part of the embodiment shown in FIG. 14.

Although the chelesta can be held by an individual's hand, it has been found desirable that a glove be secured to the cesta making play much easier. As shown in FIG. 14, a glove 30 is secured to the cesta near the proximal end 13 and the closed edge 16. Initially, the fingers 31 of the glove were sewn to the scoop means as the only means of attachment, but it was found that this permitted the hand and especially the palm to move too much relative to the scoop-cup means thereby causing a player's hand to tire rapidly. It was found necessary and as a preferred embodiment of the invention that the fingers 31 of the glove 30 are rigidly attached to the scoop means 11 by adhesive rivets, or the like. It is desirable that the palm 32 of the glove 30 is also secured fairly rigidly to the scoop and cup means such as by adhesive, a nylon hook and loop fastener (Velcro fastener), plastic or metal rivets or the like. As shown in FIG. 15, it has been found quite desirable to have an auxiliary strap 33 secured to the cup means 14 at about 34 such as by positioning the strap 33 in slots 35. The strap 33 is fastened around the player's hand in order to provide a more stable arrangement for the player's hand when using the cesta. It has been found that the wrist strap 33 preferably should be fastened around the individual player's hand on the hand side of the wrist joint in order to permit full movement of the hand during play so that the cesta is an extension of the player's arm. The wrist strap 33 can be secured around the player's hand by tying the ends thereof together, by a hook and loop fastener or the like. Alternatively, the strap 33 can be secured to the cup means by means of snaps, adhesive or the like.

An alternative embodiment of the invention depicted in FIG. 19 is where a handle 62 is secured to the cup means 14. The handle 62 can be used in place of the glove and strap means but it has been found to make play more difficult.

During play with the cesta, it has been noted by some players that they like the glove 33 positioned so that the thumb and little finger cannot grip the sides of the scoop-cup means in the area located relatively close to the proximal end 13 and the closed edge 16. Therefore, the tips of the thumb and little finger of the glove 30 are positioned close to the tips of the remaining fingers of the glove that are secured to the cesta. However, it has been determined that a majority of players like to grip the sides of the scoop-cup means and therefore the tips of the thumb and little finger are spread apart from the tips of the other fingers a sufficient distance in order to permit the desired side gripping.

In order for the game to be enjoyably played with a cesta, it was necessary to design a ball that provided a good impedance match therewith. The impedance match required that the ball have a certain size, special surface, specific weight range, dynamic coefficient of friction with respect to the cesta's inner surface 17 and a coefficient of restitution (the rebounding ability or liveliness of the ball). The impedance match is directly related to the energy transfer between the cesta's and the ball. Broadly, we determined that the ball should have a diameter range from about 5 centimeters to 7.6 centimeters and preferably from 5.7 to 6.5 centimeters. Most preferably, the ball has a diameter ranging from about 6.2 centimeters to 6.43 centimeters when the cesta is within its most preferred dimensional ranges. It was found that the balls should have a textile-type surface covering in order to provide a dynamic coefficient of friction ranging from 0.1 to 0.4 as measured between the inner surface 17 and the surface of the ball. The dynamic coefficient of friction was ascertained by tests performed on the "Instron Coefficient of Friction Fixture", Manual number 10- 53-1, Catalog number 2810-005, published and copyrighted in 1973 by the Instron Corporation. In a preferred embodiment of the invention, the flocked balls have a weight ranging broadly from 60 grams to 90 grams and more preferably from 70 grams to 88 grams. The most preferred weight range of balls is from 72 grams to 86 grams.

The balls have a coefficient of restitution e which is calculated by the formula:

$$e=\sqrt{H_2/H_1}$$

wherein $H_1$ is the known distance that a ball is dropped from over a flat rigid surface and $H_2$ is the height to which the dropped ball rebounds. It has been determined that the best balls that are impedance matched to the cesta have a coefficient of restitution ranging from 0.60 to 0.75 wherein $H_1$ is about 230 inches. Preferably, this range is about 0.65 to 0.73 and most preferably this range is about 0.67 to 0.70. It was determined that the textile-type outer surface could be a non-woven textile material and more preferably the outer surface of the ball was covered with a flocked material. The material covering the outer surface can be selected from textile fibers of fiber glass, nylon, polyester, acrylic, wool, cotton, rayon, silk, polypropylene and the like. It was found that the balls having a good impedance match with the cesta are made of substantially solid foamed material that may have a thin outer surface film surrounding the ball underneath a flocked surface. However, non-foamed balls can also perform adequately.

The following Table III lists a group of balls determined to comprise a good impedance matched to the cesta:

TABLE III

| Ball | Weight in Grams | e* |
|---|---|---|
| I | 84 | .69 |
| II | 80 | .68 |
| III | 74 | .68 |
| IV | 86 | .73 |
| V | 72 | .64 |
| VI | 72 | .64 |

*$H_1$drop height approximately 230 inches

Other balls such as standard racquetballs, handballs and squashballs were used with the cesta but proved not to have a good impedance match and therefore when a game was played it was found to be not very enjoyable or pleasurable.

For average size individuals, the limits of the length of this cesta are surprisingly narrow. Over the length range of about 45 to 60 centimeters, the cesta becomes clumsy and unwieldly. Conversely, at about 30 centimeters or less, the power and the pleasure in throwing the ball are gone since so much snap is required as to be hard on a player's wrist. There is a good reason why these length limitations are so. The length and mass distribution combine to give a moment of inertia about the wrist joint. This moment is critical to giving a good impedance match between the human being and the ball. With a good impedance match you have a very enjoyable game—with poor impedance match you have no game at all.

Figure 16:
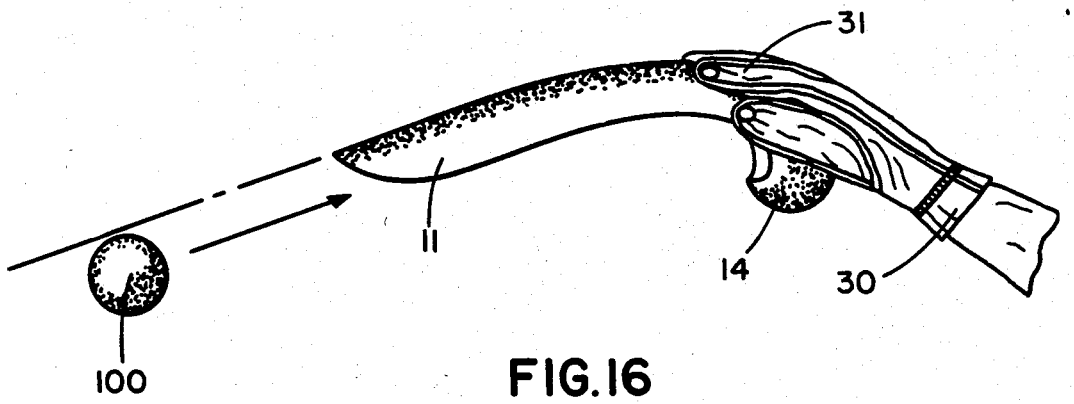
FIG. 16 is a side elevation view of one embodiment of the invention wherein the ball is tangent to the curve of the scoop means.

The cesta is designed to make a successful catch at any angle up to normal near the tip and anywhere in the scoop if the angle is substantially tangential, see FIG. 16.

The most difficult part of the design is to satisfy the condition when the ball hits approximately normal or perpendicular to the scoop curve. The mechanism of ball capture by our cesta was analyzed both before and after impact of the ball to insure that the cesta was impedance matched to the ball so that the ball will not rebound from the cesta.

By adapting standard mechanics principles for the conservation of angular momentum, a formula was obtained that predicted whether or not the cesta will capture the ball when it strikes the scoop means approximately normal or at an angle directed toward the cup means. This formula is:

$$(mL^2)/I > e$$

wherein:

m = the mass of the ball in grams;

L = the distance from the point of impact of the ball 100 (see FIG. 17) about an axis* at 40 passing through the wrist of a player holding the cesta wherein 40 is approximately 2 inches from the end 42 of the cup 14 or the axis at 41;

*The axis at 40 and 41 is perpendicular to the axis of symmetry PS of the cesta as shown in FIG. 3.

Figure 17:
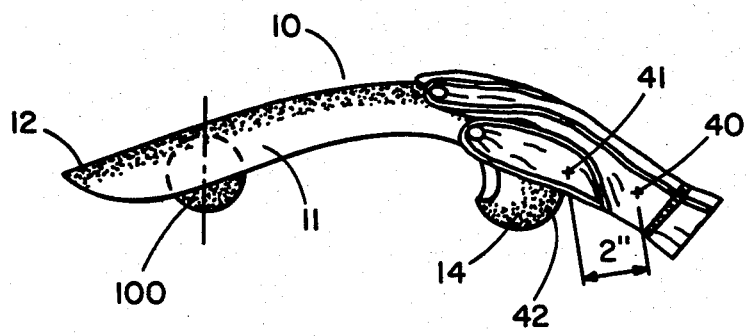
FIG. 17 is a side elevation view of one embodiment of the invention depicting the ball striking the scoop means and the relative position between the axis 40 and other parts of the invention.

I = the polar moment of inertia about the axis at 40 including the weight of the hand and glove as shown in FIG. 17; and e = the coefficient of restitution of the ball.

It has been found that the cesta alone has a polar moment of inertia about an axis 40 perpendicular to the plane of symmetry PS (see FIG. 3) ranging from $6\times10^4$ to $12\times10^4$ gm/cm$^2$. This particular characteristic is used in designing out cesta so that the ball will not rebound from the scope means.

The following examples of cestas are made in accordance with this invention and should not be construed in any way to limit the scope contemplated by this invention.

EXAMPLE I

A cesta, similar to the one shown in FIG. 1, had the following physical and structural characteristics:

(1) weight = 156 grams;
(2) length = 17 inches or about 43 centimeters;
(3) cross-sectional configuration is a modified U-shape similar to FIG. 11;
(4) thickness is approximately 2 millimeters;
(5) the distance from the distal end that the ball strikes the scoop means is about 3 inches or 8 centimeters; therefor $L=(48-8)=40\times$cm;
(6) the mass of the ball is 84 grams;
(7) the polar moment of inertia is $14.5\times10^4$ grams-centimeters$^2$;
(8) the coefficient of restitution for the 84 gram ball is 0.69; and
(9) the center of gravity from the end of the cup is about 7 inches or 17¾ centimeters;

Therefore, $$\frac{84\times(40)^2}{14.5\times10^4} = .91 > .69$$

EXAMPLE II

A cesta, similar to the one shown in FIG. 1, had the following physical and structural characteristics:

(1) weight = 158 grams;
(2) length = 17 inches or approximately 43 centimeters;
(3) cross-sectional configuration of the scoop means is a modified V-shape similar to FIG. 10;
(4) thickness is approximately 2½ millimeters;
(5) the distance from the distal end that the ball strikes the scoop means is about 5 inches or 12 centimeters; therefore, $L=(48-12)=38$ centimeters;
(6) the mass of the ball is 74 grams;
(7) the polar moment of inertia is $12.4\times10^4$ gram-centimeters$^2$;
(8) coefficient of restitution for the 84 gram ball is 0.68;
(9) the center of gravity from the end of the cup is 6 inches or about 15.3 centimeters.

Therefore, $$\frac{(74)\times(36)^2}{12.4\times10^4} = .79 > .68$$

EXAMPLE III

A cesta, similar to the one shown in FIG. 1, had the following physical and structural characterists:

(1) weight = 183.5
(2) length = 17 inches or about 43 centimeters
(3) the cross-sectional configuration of the scoop means, modified U-shape similar to FIG. 11;
(4) the thickness is approximately 2 millimeters;
(5) the distance from the distal end that the ball strikes the scoop means is about 4 inches or 10 centimeters, therefore $L=(48-10)=38$ centimeters;
(6) the mass of the ball is 80 grams;
(7) the polar moment of inertia is about $13.9\times10^4$ grams-centimeters$^2$;
(8) the coefficient of restitution of the 80 grams ball is 0.68;
(9) the center of gravity from the end of the cup is about 6 inches or about 15.3 centimeters.

Therefore, $$\frac{80\times(38)^2}{13.9\times10^4} = .82 > .68$$

As can be seen from Examples I, II and III, the cestas satisfy the condition that the different weight balls will be captured when they hit the scoop means because in each example the left-hand side of the equation is greater than the coefficient of restitution for the ball.

Once the basic embodiments of the cesta and ball were defined, these embodiments of the invention were used in a court. It was found that a simple solid wall, i.e., such as a concrete wall, could be used by one or more players to play a rudimentary-type game (the wall was similar to a tennis batting board or tennis practice wall). It was also found that a slightly more sophisticated game could be played with the cesta and ball in a three walled court (front wall and side walls) such as exists in some parts of the United States (particularly in areas with warmer climates). We determined that the preferred embodiment of our invention of combining the cesta, ball and court into a total game could best be accomplished by tuning the cesta and ball for play in a standard racquetball court. The standard racquetball court which has a first pair of walls each about 40 feet long, a second pair of walls each about 20 feet long, a floor with each of the walls being approximately perpendicular to the floor and the walls being at least 10 feet high was by far the best playing court. However, a squash court is useable with balls having a lower coefficient of restitution.

The preferred embodiments of the chelesta and ball as described hereinbefore are those that were tuned or impedanced matched to a racquet ball court in order to produce a pleasurable came to play, thus, providing kinesthetic pleasure to the players.

Once the preferred type of court was selected for our game, balls were tested in the court to insure a good cesta-ball match to the court. Balls having a coefficient of restitution (calculated at about a 230 inch drop) of less than 0.6 were found not lively enough to play since the ball would not rebound with a sufficient velocity from the front playing wall with a normal throw. Conversely, balls having a coefficient of restitution greater than 0.75 were determined to be too lively. The most satisfactory balls are those having a coefficient of restitution of about 0.64 to about 0.73.

This cesta-ball-court combination produces a synergistic relationship between the three components that provide a unique, playable and pleasurable game. This synergistic effect can be better understood because it is fully contemplated by the invention that when energy is transferred from one system to another, whether it be an amplifier driving an audio speaker, a hammer driving a nail or a cesta either catching or throwing a ball, that this energy transfer is the most efficient when there is good impedance match between the two systems. In the cesta ball game there must be good impedance match between the four basic elements, to wit: the cesta, the ball, the court and a human. This term "impedance matching" is difficult to explain to one unfamiliar with the concept, even though the process of impedance matching is used constantly by many people. As an example of a very poor impedance match where there is substantially no energy transfer, suppose a ping pong ball is lying on a billiard table and it is struck by a similar size steel ball. The ping pong ball flies off the table but the steel ball continues rolling along its path almost unaffected by the impact because there has been very little transfer of energy. Conversely, if the steel ball is at rest and is hit by a ping pong ball, then the steel ball barely moves and the ping pong ball rebounds with almost its initial speed. Again, there has been very little energy transfer.

On the other hand, when a billiard ball hits another billiard ball squarely, there is almost a 100 percent transfer of energy because of the nearly perfect impedance match. Thus, the impedance of a system might be characterized as a degree of difficulty met in transferring energy to or from that system.

When energy is to be transferred from one system to another of greatly differing impedance, an appropriate "transformer" is used as an impedance-matching device. For example, to change a tire, a jack is used to match the impedance of the man to that of the weight of the car. To drive a nail, a hammer is used to match the impedance of a man to that of the nail—and no one uses a hammer to close a door because the impedance match is already pretty good between the individual and the door—no transformer is necessary. An example may aid in appreciating the importance of the accurate impedance match: visualize attempting to play tennis with a badminton racquet or badminton with a tennis racquet. One is almost impossible as the other, though the two racquets are almost identical in structure; a strong frame with an elongated handle. A tennis racquet is not a good impedance matching transformer between a human and a badminton birdie, and a badminton racquet is not a good impedance-matching transformer between a human and a tennis ball. In most sports, this impedance match has been worked out by trial and error over extended periods of time, some times as much as centuries. In our invention, this process of impedance matching has been greatly accelerated by careful mathematical analysis and tuning the cesta, ball and court to humans to produce a pleasurable game.

Figure 18:
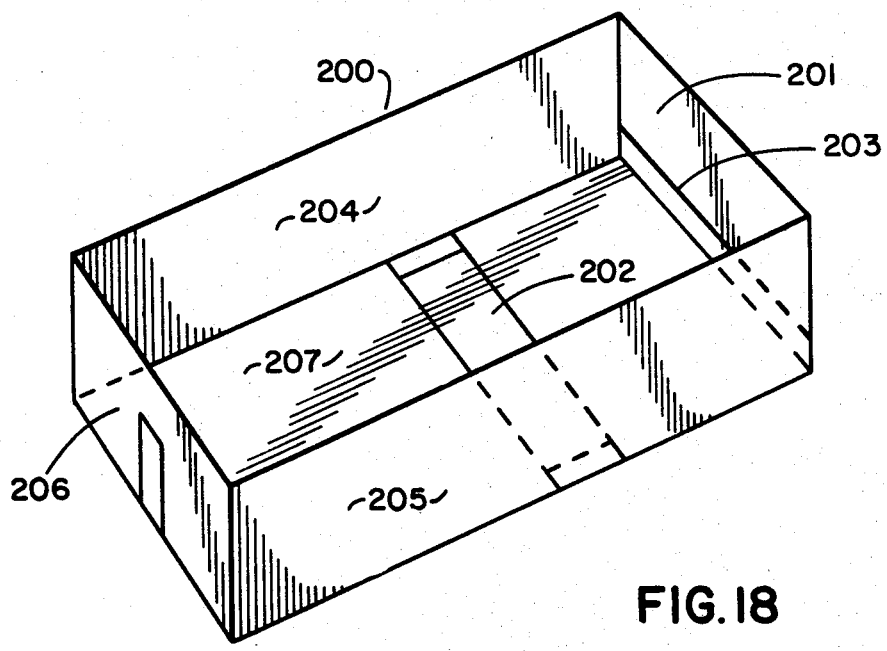
FIG. 18 is a perspective view of one embodiment of a court.

Consequently, our cesta ball game invention is completely different from all court style games such as tennis, racquetball, squash, badminton, aerial darts (a badminton type game played with a hard paddle and a birdie) since the racquet is used in court play to strike or hit the ball or birdie. Our cesta ball game has one similarity to handball in that it is played in a closed wall court; however, in handball the ball coming off the forward wall is not caught but struck or hit with the hand. Our cesta ball game does have two aspects similar to jai alai in that a ball catching device is used to catch and the same device is used to throw the ball. We have developed our game utilizing the unique relationship between the cesta, the ball and the court such that the ball is of a sufficient dynamic coefficient of friction between the ball and scoop means whereby the catching and throwing element causes a ball to roll off the scoop means with spin thereby being able to produce unique shots that rebound off the front and side walls in an unexpected manner. In the perspective view of the court arrangement shown in FIG. 18, the court 200 has a front wall 201 and a serving box 202 that is approximately 5 feet wide located about 15 feet back from the front wall 201. The front wall also has a telltale line 203 located between 12 inches to 18 inches above the floor line.

One of the most outstanding and unique characteristics of the game is that when the scoop-cup element is used by a player properly (after the element has been secured to the player's hand properly) and wherein the scoop-cup element or cesta is held approximately parallel to the floor, that a ball rebounding from the front wall striking the scoop means between the distal end 12 and within a distance of approximately 20 centimeters from the distal end (toward the cup means), that the ball will travel or roll up into the cup means 14 if there is a slight give by the player's hand. The ball striking the scoop means is depicted in FIG. 17. The prevention of bounce out of the ball from the scoop means is due to the design of the scoop means such that the coefficient of restitution of the ball is less than the value of the quantity $$mL^2/I$$

for the scoop-cup element or cesta. This same catching ability applies to balls rebounding from side walls or the floor; but, it is most dramatic when the scoop-cup element or cesta is held parallel to the floor. This inventive feature of the invention completely distinquishes it from all other game playing devices or games.

In playing the cesta ball game, the ball is served by the first player by first bouncing the ball within the confines of the served box 203 and then capturing or catching the ball with the scoop-cup element (more narrowly referred to herein before as a cesta) and propelling the ball toward the front or forward wall 201. The second player must catch the ball in the element before it bounces on the floor twice. Once caught, the second player can throw the ball toward the front wall 201 directly. Alternatively, the second player can throw the ball towards one of the elongated side walls 204 or 205 in such a manner that the ball will ultimately strike the front wall 201, rebounding therefrom directly or from another elongated side wall. The first player must then catch and throw the ball ultimately back towards the front wall 201 as described above. A "legal return" as used hereinafter defines the proper return of a ball from the front or side walls by catching the ball while in play, either on the fly or after a first bounce on the floor and before the ball touches the floor a second time. The ball can rebound directly from the front wall 201, a side wall 204 or 205 or directly from the back wall 206 and still be in play. Each legal return after a serve is called a "rally". Play during the rally comprises:

(1) front and side wall returns wherein the ball rebounds from the front wall 201, the side wall 204 or 205, the ceiling (if there is one) or the floor 207 and must be caught cleanly and thrown back toward the front wall 201 without a noticeable pause, or (2) a back wall return wherein the ball rebounding from the back wall 206 is thrown without a separate catching motion (with the effect that the ball's motion toward the front wall 201 is not slowed down as a result of the ball's contact with the scoop-cup element).

When a cesta is used for a back wall return, the ball stays within the scoop means 11 and never enters into the cup means 14. This type of play off the back wall 206 is referred to as a rebote. The time the ball is in the scoop means 11 must be less than one second, and preferrably only a fraction of a second. Any ball that contacts the playing element, i.e., the cesta, more than once during any return is called a "juggle" and results in a point out or fault.

Points are scored only when the serving player or side (if doubles are played) serves an ace (a legal serve that is not returned by the receiving player) or wins a rally because the other player or side has committed a fault.

In the event that the ball strikes the front wall on or below the telltale line 203 then a fault is declared.

It has been found that the dynamic coefficient of friction between the ball and the walls of the court should range from 0.1 to 0.4 and can be measured in a manner similar to the method used to measure the dynamic coefficient of friction between the ball and the scoop means.

Although specific embodiments of the invention have been described, many modifications and changes may be made in the configurations of the scoop-cup element or cesta, the cesta and ball combination and the game equipment combination without departing from the spirit and scope of the invention as defined in the appended claims.

What is claimed is:

1. A ball catching and throwing device for playing a ball game comprising:

(a) an elongated scoop means having inner and outer surfaces, a distal end, a proximal end and a pair of outwardly and upwardly facing edges between the distal end and the proximal end thereof;

(b) a curvilinear-shaped ball cup means having inner and outer surfaces, an open edge and a closed edge, the closed edge secured to the proximal end of the scoop;

(c) the scoop means having an elongated central first axis extending from the distal end to the proximal end, a portion of the scoop means along the first axis having a portion thereof in the configuration of a segment of a hyperbolic spiral, the spiral having a formula in which the polar coordinates $R\theta$ equal a constant $C$ ($R\theta = C$) and wherein the values of R range from 1.5 to 60 centimeters and the values of the constant C range from 10 to 30 centimeter-radians when $\theta$ is measured in radians.

2. The device of claim 1 wherein the first axis defines a plane of symmetry for the scoop-cup means and divides the scoop-cup means into a right-hand section and a left-hand section.

3. The device of claim 2 having a polar moment of inertia about a second axis displaced two inches from the end of the cup means that is perpendicular to the plane of symmetry ranges from $6\times10^4$ to $12\times10^4$ grams-centimeters$^2$.

4. The device of claim 1 wherein the scoop means has a mass ranging from 130 to 300 grams.

5. The device of claim 1 wherein the scoop means has a length measured from the end of the cup means to the distal end ranging from 30 centimeters to 60 centimeters.

6. The device of claim 1 wherein the scoop-cup means has a holding means near the proximal end so that the scoop-cup means can be gripped by an individual.

7. The device of claim 6 further including use of a ball utilized in throwing and catching.

8. The device of claim 7 wherein the ball has a mass range from 70 grams to 90 grams.

9. The device of claim 7 wherein the ball has a mass ranging from 72 grams to 86 grams.

10. The device of claim 7 wherein the ball has a surface covered with short flocking material.

11. The device of claim 7 wherein the ball has a surface covered with a non-woven textile material.

12. The device of claims 10 or 11 wherein the material covering the ball is selected from the group consisting of fiberglass, nylon, polyester, acrylic, wool, cotton, rayon, silk, and polypropylene.

13. The device of claim 12 wherein the dynamic coefficient of friction of the surface of the ball measured against the surface of the scoop means ranges from 0.1 to 0.4.

14. The device of claims 7, 8, 9, 10 or 11 wherein the ball has a diameter ranging from about 5.5 centimeters to 7 centimeters.

15. The device of claims 7, 8, 9, 10 or 11 wherein the ball has a diameter ranging from about 6 centimeters to 6.4 centimeters.

16. The device of claims 7, 8, 9, 10 or 11 wherein the dynamic coefficient of friction of the surface of the ball measured against the surface of the scoop means ranges from 0.1 to 0.4.

17. The device of claim 7 wherein the ball has a coefficient of restitution e defined by the formula $e=\sqrt{H_2/H_1}$, wherein $H_1$ is the distance the ball is dropped from a known height over a flat concrete surface and $H_2$ is the rebound height.

18. The device of claim 17 wherein $H_1$ is about 230 inches and the coefficient of restitution of the ball ranges from 0.65 to 0.72.

19. The device of claim 17 wherein $H_1$ is about 230 inches and the coefficient of restitution of the ball ranges from 0.67 to 0.70.

20. The device of claim 6 wherein the holding means is a hand attachment means secured to the cup-scoop means.

21. The device of claim 20 wherein the attachment means is a glove secured to the cup-scoop means.

22. The device of claim 21 wherein the glove is firmly secured to the scoop-cup means.

23. The device of claim 21 wherein the glove is moveably secured to the scoop-cup means so that the position of the glove can be altered to accommodate the individual's playing habits.

24. The device of claim 21 wherein the fingers of the glove are secured to the scoop-cup means.

25. The device of claim 24, wherein the palm is also secured to the scoop-cup means.

26. The device of claim 21 wherein the attachment means is a strap.

27. The device of claims 26 wherein a wristband is secured to the cup-scoop means such that the wristband will wrap around an individual's hand once it is positioned in the hand attachment means.

28. The device of claim 27 further including means for securing the wristband tightly around the hand.

29. The device of claim 28 wherein the means for securing is a nylon hook and loop fastener.

30. The device of claim 28 wherein the means for securing comprise tieable ends of the wristband.

31. The device of claim 27 wherein the wristband is secured by a snap means to the cup means.

32. The device of claim 21 further including slots in the cup means.

33. The device of claim 32 wherein a wristband is positioned in the slot.

34. The device of claim 20 wherein the hand attachment means and a wristband are used to secure an individual's hand to the scoop-cup means enabling the individual to catch and throw the ball.

35. The device of claim 20 wherein the hand attaching means is capable of securing a human hand to the scoop-cup means combination in such a fashion that the hand need not grip the sides of the cup means.

36. The device of claim 20 wherein the hand attaching means is capable of securing a human hand to the scoop-cup means whereby the hand can grip the sides of the cup-scoop means.

37. The device of claim 1 wherein the first axis divides the scoop-cup combination into right-hand and left-hand matching sections.

38. The device of claim 37 wherein the right-hand and left-hand sections are opposite but equal.

39. The device of claims 1 wherein the device is made from a plastic material selected from a group consisting of ABS, epoxy, polypropylene, polyethylene, polycarbonate, polyester, polyimide, polyamide, and phenolic.

40. The device of claim 1 wherein the scoop-cup means combination is made from a laminated material of plastic and fabric.

41. The device of claim 40 wherein the scoop-cup means combination as made from a plastic impregnated fabric textile material.

42. The device of claim 40 wherein the textile material is selected from one of the group consisting of fiberglass, graphite, nylon, cotton, wool, polyester, kevlar and mineral wool.

43. The device of claim 1 wherein the scoop means has a V-shaped cross-sectional configuration.

44. The device of claim 1 wherein the scoop means has a modified V-shaped cross-sectional configuration.

45. The device of claim 1 wherein the scoop means has a partial V-shaped cross-sectional configuration.

46. The device of claim 1 wherein the scoop means has a U-shaped cross-sectional configuration.

47. The device of claim 1 wherein the scoop means has a modified U-shaped cross-sectional configuration.

48. The device of claim 1 wherein the scoop means has a partial U-shaped cross-sectional configuration.

49. The device of claim 43, 44, 45, 46, 47 or 48 wherein the width of the scoop means ranges from 6 centimeters to 13 centimeters.

50. The device of claims 43, 44, 45, 46, 47 or 48 wherein the depth of the scoop means ranges from 2 centimeters to 6 centimeters.

51. The device of claims 43, 44, 45, 46, 47 or 48 wherein the scoop means has a width ranging from 9 centimeters to 13 centimeters at a distance ranging from about 5 centimeters to 10 centimeters from the distal end of the scoop means.

52. The device of claims 43, 44, 45, 46, 47 or 48 wherein the scoop means has a width ranging from 8.5 centimeters to 12 centimeters at a distance ranging from about 10 centimeters to 15 centimeters from the distal end of the scoop means.

53. The device of claims 43, 44, 45, 46, 47 or 48 wherein the scoop means has a width ranging from 8 centimeters to 11.5 centimeters at a distance ranging from about 15 centimeters to 20 centimeters from the distal end of the scoop means.

54. The device of claims 43, 44, 45, 46, 47 or 48 wherein the scoop means has a width ranging from 7.5 centimeters to 10.5 centimeters at a distance ranging from about 20 centimeters to 25 centimeters from the distal end of the scoop means.

55. The device of claims 43, 44, 45, 46, 47 or 48 wherein the scoop means has a width ranging from 6.5 centimeters to 9.0 centimeters at a distance ranging from about 25 centimeters to 30 centimeters from the distal end of the scoop means.

56. The device of claims 43, 44, 45, 46, 47 or 48 wherein the scoop means has a width ranging from 6 centimeters to 9 centimeters at a distance ranging from about 30 centimeters to 35 centimeters from the distal end of the scoop means.

57. The device of claim 1 wherein the thickness from the inner surface to the outer surface of the scoop means ranges from 0.125 centimeters to 1.0 centimeters.

58. The device of claims 1 wherein the scoop-cup means is made from a textile material impregnated by a plastic foam material.

59. The device of claim 58 wherein the plastic foam is a material selected from one or more of the group consisting of polyurethane, polyester, polyamid and syntactic foams.

60. The device of claims 1 wherein the scoop-cup means is formed by a sandwich arrangement with the outer surface being textile material and the inner surface comprising a plastic foam material.

61. The device of claim 60 wherein the plastic foam material is selected from one or more of the group consisting of polyester, polyurethane, syntactic foams and blown cellular material.

62. The device of claim 60 wherein the scoop-cup means is made by injecting plastic foam material into a chillable mold thus forming two hard outer skins.

63. The device of claim 1 wherein when the scoop-cup means is held by a person so that the scoop-cup means is held substantially perpendicular to the floor and when the ball is rebounding from the front or side wall and strikes the scoop means between the distal end and within approximately up to 20 centimeters from the distal end; the ball will travel into the cup means if there is a slight give by the hand holding the scoop-cup means.

64. Cestaball game equipment comprising:

(A) a rectangular court having a floor and two pairs of oppositely facing walls, one pair of walls being approximately 40 feet long and the other pair of walls being approximately 20 feet long, the walls being at least 10 feet high;

(B) a ball adapted to be used in the court and having a mass ranging from 70 to 90 grams; and (C) at least one catching and throwing element having a scoop means having an elongated central first axis extending from the distal end to the proximal end, a portion of the scoop means along the first axis having a portion thereof in the configuration of a segment of a hyperbolic spiral, the spiral having a formula in which the polar coordinates $R\theta$ equal a constant $C(R\theta=C)$ and wherein the values of R range from 1.5 to 60 centimeters and the values of the constant C range from 10 to 30 centimeter-radians when $\theta$ is measured in radians.

65. The device or equipment of claims 64 or 1 wherein the scoop means has a plurality of holes therein.

66. The equipment of claims 64 or 1 wherein when an individual holds the scoop-cup device and catches a ball rebounding from a wall such that the ball first strikes the inner surface of the scoop means and rolls into the cup means in a manner such that kinesthetic pleasure is provided to the individual.

67. The equipment of claim 64 wherein the court has walls perpendicular to the floor and adjacent walls are perpendicular to each other.

68. The equipment of claim 67 wherein the court has a tell tale line above the floor located on one of the 20 foot walls.

69. The equipment of claim 64 wherein the ball is substantially solely foam material.

70. The equipment of claim 64 wherein the dynamic coefficient of friction between the ball and the walls range from 0.1 to 4.

71. The equipment of claim 64 wherein the court, ball, scoop-cup means and player are all impedence matched to each other so that the player catching and throwing the ball with the scoop-cup means in the court provides kinesthetic pleasure to the player playing therewith.

72. The equipment of claim 64 wherein the scoop-cup device has a mass ranging from 150 to 300 grams.

73. The equipment of claim 64 wherein scoop-cup device has a length measured from the end of the cup means to the distal end ranging from 30 centimeters to 60 centimeters.

74. The equipment of claim 64 wherein the scoop-cup device has a polar moment of inertia about an axis displaced two inches from the end of the cup means perpendicular to the plane of symmetry of the device and ranging from $6\times10^4$ to $12\times10^4$ grams-centimeters$^2$.

75. The equipment of claim 64 wherein the ball has a surface covered with short flocking material.

76. The equipment of claims 75 wherein the dynamic coefficient of friction of the surface of the ball is measured against the surface of the scoop means ranges from 0.1 to 0.4.

77. The equipment of claim 64 wherein the ball has a surface covered with a non-woven textile material.

78. The equipment of claims 75 or 77 wherein the material is selected from the group consisting of nylon, polyester, acrylic, wool, cotton, rayon, silk and polypropylyne.

79. The equipment of claim 78 wherein the dynamic coefficient of friction of the surface of the ball measured against the surface of the scoop means ranges from 0.1 to 0.4.

80. The equipment of claim 77 wherein the dynamic coefficient of friction of the surface of the ball measured against the surface of the scoop means ranges from 0.1 to 0.4.

81. The equipment of claim 64 wherein the ball is covered with a polymeric coating.

82. The equipment of claim 81 wherein the dynamic coefficient of friction of the surface of the ball measured against the surface of the scoop means ranges from 0.1 to 0.4.

83. The equipment of claim 64 wherein the ball has a coefficient of restitution defined by the formula $e=\sqrt{H_2/H_1}$ wherein $H_1$ equals the distance the ball is dropped from a known height over a flat concrete surface and the rebound height is measured as $H_2$.

84. The equipment of claim 83 wherein $H_1$ is about 230 inches and the coefficient of restitution of the ball ranges from 0.60 to 0.75.

85. The equipment of claim 83 wherein $H_1$ is about 230 inches and the coefficient of restitution of the ball ranges from 0.65 to 0.72.

86. The equipment of claim 83 wherein $H_1$ is about 230 inches and the coefficient of restitution of the ball ranges from 0.67 to 0.70.

87. The device of claim 64 wherein when the scoop-cup means is held by a person so that the scoop-cup means is held substantially perpendicular to the floor and when the ball is rebounding from the front or side wall and strikes the scoop means between the distal end and within approximately up to 20 centimeters from the distal end; the ball will travel with the cup means if there is a slight give by the hand holding the scoop-cup means.

* * * * *